US006148650A

United States Patent [19]

Kibble

[11] Patent Number: 6,148,650

[45] **Date of Patent: *Nov. 21, 2000**

[54] BOLT UNIT AND FRAME ARRANGEMENT

[75] Inventor: Anthony Wilfred Kibble, Sutton Coldfield, United Kingdom

[73] Assignee: Home Doors Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/983,569

[22] PCT Filed: Jun. 26, 1996

[86] PCT No.: PCT/GB96/01530

§ 371 Date: Dec. 24, 1997

§ 102(e) Date: Dec. 24, 1997

[87] PCT Pub. No.: WO97/01690

PCT Pub. Date: Jan. 16, 1997

[30] Foreign Application Priority Data

Jun. 29, 1995 [GB] United Kingdom ..... 9513240
Jun. 6, 1996 [GB] United Kingdom ..... 9611840

[51] Int. Cl.[7] ..... E05B 65/06

[52] U.S. Cl. ..... 70/134; 70/106; 70/110; 70/470

[58] Field of Search ..... 70/106, 110, 111, 70/134, 141, 144, 467, 469, 470, 471, 484, 485, 348, 349, 150

[56] References Cited

U.S. PATENT DOCUMENTS

| | | | |
|---|---|---|---|
| 124,424 | 3/1872 | Dodson | 70/143 |
| 326,673 | 9/1885 | Paciorkowski | 70/134 |
| 448,912 | 3/1891 | Dény | 70/143 |
| 460,498 | 9/1891 | Berry | 70/134 |
| 504,292 | 8/1893 | Badoni | 70/134 |
| 653,946 | 7/1900 | Colletti et al. | 70/143 |
| 709,309 | 9/1902 | Eicher | 70/134 |
| 720,455 | 2/1903 | More . | |
| 895,174 | 8/1908 | Edey . | |
| 1,006,816 | 10/1911 | Wolfe | 70/143 |
| 1,077,120 | 10/1913 | Boldizs | 70/134 |
| 1,092,414 | 4/1914 | Wellisch | 70/143 |
| 1,180,943 | 4/1916 | Praźmo | 70/143 |
| 1,301,979 | 4/1919 | Schonwald . | |
| 1,325,919 | 12/1919 | Voight . | |
| 1,359,347 | 11/1920 | Fleisher . | |
| 1,378,504 | 5/1921 | White | 70/143 |
| 1,383,801 | 7/1921 | Glisoni et al. | 70/143 |
| 1,439,332 | 12/1922 | Schulte | 70/143 |
| 1,462,828 | 7/1923 | Rixson . | |
| 1,519,070 | 12/1924 | Soley | 70/143 |
| 2,119,175 | 5/1938 | Niederdrenk . | |
| 2,869,351 | 1/1959 | Rolph | 70/134 |

FOREIGN PATENT DOCUMENTS

| | | | |
|---|---|---|---|
| 726861 | 6/1932 | France | 70/14 |
| 42509 | 3/1888 | Germany | 70/134 |
| 306090 | 6/1918 | Germany | 70/143 |
| 349239 | 2/1922 | Germany | 70/143 |
| 89071 | 7/1922 | Germany | 70/134 |
| 429316 | 8/1926 | Germany | 70/143 |
| 171361 | 5/1952 | Germany | 70/143 |
| 1250761 | 9/1967 | Germany | 70/134 |
| 23611 | 4/1901 | Switzerland | 70/143 |
| 23 854 | 10/1897 | United Kingdom | 70/143 |
| 22723 | 11/1899 | United Kingdom | 70/143 |
| 585774 | 2/1947 | United Kingdom | 70/143 |
| 2293621 | 4/1996 | United Kingdom . | |

*Primary Examiner*—Bethann C. Dayoan
*Assistant Examiner*—Clifford B. Vaterlaus
*Attorney, Agent, or Firm*—Steven J. Hultquist; William A. Barrett

[57] ABSTRACT

This invention relates to a bolt unit and frame arrangement. In particular it relates to a lockable bolt unit having a slidable bolt, typically for securing two moveable panels together or for securing one moveable panel to a fixed frame.

11 Claims, 5 Drawing Sheets

BOLT UNIT AND FRAME ARRANGEMENT

FIELD OF THE INVENTION

This invention relates to a bolt unit and frame arrangement. In particular it relates to a lockable bolt unit having a slidable bolt, typically for securing two movable panels together or for securing one movable panel to a fixed frame.

In this specification, "left" and "right" and similar geometric terms refer to parts in their condition of use as illustrated in FIG. 1, unless otherwise specified in relation to a drawing.

The following disclosure will refer to door panels, and for such applications the bolt may be resiliently biassed and with a chamfered end to permit a latching engagement. However, the bolt unit of the invention can be fitted to windows and other movable panels, and for these applications the bolt unit can have for example a non-chamfered bolt and be moved by an actuator to its engaged position.

BACKGROUND OF THE INVENTION

Both sliding and hinged doors need the facility to be made secure against unauthorised opening. Bolt units have therefore been developed which have fittings for attachment to an external surface of the door, specifically with the bolt being slidable in a bolt housing or casing between guides; in use the bolt unit includes a slidable bolt which can be moved into and out of engagement with a keeper secured to a fixed member, usually to the upright of a fixed outer door frame within which the door panel is hingedly mounted.

A door secured by a bolt unit is often vulnerable to unauthorised opening upon "bursting" of the securement, with the bolt being disengaged from its keeper. Such bursting of the bolt can for instance be effected by a blow impacting on the door edge perpendicular to the plane of the door, and which for a hinged door would be delivered in the door opening direction. A bolt is strong against bending and shear forces, but nevertheless if the bolt is mounted in cantilever the inserted (unsupported) and can often be sprung from its keeper by a determined blow.

It is of course desirable that unlawful opening movement of a door generally parallel to its plane (as might occur by use of a housebreaker's jemmy) also be made more difficult. Improved security against bursting movement perpendicular to the door frame should not result in reduced security against unauthorised opening parallel to the door frame; it is an advantage of embodiments of the invention that increased security can be provided against such attempted door openings parallel to its plane.

DISCLOSURE OF THE PRIOR ART

Bolts are widely used as fastening for hinged gates and include a bolt end which can slidably be moved into an aperture in a fixed upright, to prevent the gate swinging on its hinge.

More sophisticated bolt units have long been available in which the bolt is mounted in a housing, perphaps with the bolt fully concealed in the housing when in the retracted, inoperative condition, and with the housing carrying actuating means which can be used to move the bolt into a "holding" position with its one end projecting from the housing; with the housing mounted to a hinged door, if the projecting end of the bolt in this holding condition is fitted into an aperture (for instance in a fixed upright forming part of a frame for the door) then the door is held against swinging about the hinge(s).

The bolt unit will often have a key-controlled lock which can be operated to secure the bolt in its extended "holding" position.

For greater security, fabricated (metal) keepers secured to the upright are used instead of apertures cut in the upright.

Some bolt units have a latching action, in which the bolt is chamfered and biassed towards its holding position by a spring; when such a bolt engages its keeper as by the panel being closed, the chamfer causes the bolt to be retracted into its non-holding position until it enters the keeper aperture. Such latch action bolts can be fitted to the rim of a door and are then referred to as "rim latches"; they can also be secured in the holding position by a lock.

Rim latches are widely used to secure external doors in homes and offices, and for this purpose are mounted to an interior surface of the door; often the lock will be key operated from both inside and from outside the door, but some rim latches can additionally, or alternatively, be opened by rotating a thumb-turn located inside the door so as manually to force the bolt back against the latch spring.

SUMMARY OF THE INVENTION

We seek to provide a bolt unit which when fitted in a frame arrangement is less susceptible to unauthorised opening as by bursting or jemmying than the known bolt units.

According to one feature of the invention we provide a bolt unit which includes a bolt housing, bolt guides in the housing and a bolt slidable between said guides so that one end of the bolt can be outside the housing characterised by a receptor for said one end of the bolt outside of the housing, said receptor being carried by the housing and movable therewith.

Preferably, the bolt unit has resilient bias means in the housing, said resilient bias means acting to urge the said one end of the bolt in a direction away from a non-holding position and towards a first holding position with said one end outside of the housing, and in that said one end of the bolt has a chamfer, with a chamfer angle relative to said direction such that a force against said chamfer and substantially perpendicular to said direction can cause the said one end to move away from said first holding position and towards said non-holding position.

We can also provide a bolt unit which includes a bolt movable between a first holding position and a second holding position. Preferably the bolt should be lockable in the second holding position.

Thus according to a preferred feature of the invention the bolt unit has a first movement means mounted in the housing, the first movement means being adapted to allow one end of the bolt to move in a direction between a non-holding position and a first holding position, said first holding position being outside the housing, and a second movement means mounted in the housing, the second movement means being adapted to allow the said one end of the bolt to move further in said direction and into a second holding position, the said one end of the bolt being engaged with the receptor in said second holding position.

For a latch arrangement, preferably the first movement means restrains movement of the bolt, the bolt being moved by a spring in the said direction when the movement means is removed. Preferably the second movement means drives the bolt further in the said direction. Thus the latch uses a "single throw" bolt movement means.

For bolt withdrawal, preferably the second and first movement means successively drive the bolt in the opposite direction to the said direction, firstly from the second holding position to the first holding position, and then from the first holding position to the bolt retracted position (allowing door opening).

The first and second movement means can be provided by a single component, such as a rotatable actuator perhaps capable of multiple revolutions in both angular directions. In a preferred latching embodiment, the actuator has a permitted angular movement of 200–240 degrees, typically with a rotation of 20–60 degrees to clear the bolt to allow the spring to move the bolt to the first holding position, and a further full 180 degree rotation to move the bolt to the second holding position.

The first and second movement means can however be provided by separate components. For office doors and the like having lockable bolt units, key holders can for instance use their key during the day to move the bolt (or a number of bolts on selected doors) between the first holding position and a withdrawn condition (allowing door opening); security staff can use their key to move the bolt to the second holding position. The lock casing can be of any known design, including for instance one using a split key (with one part of the key being used by the key holder for movement of the bolt between its first holding and non-holding positions, and both parts by security staff for movement of the bolt into and out of its second holding position).

The bolt housing carries a receptor with which the one end of the bolt engages in the second holding position. Thus in the assembled condition and according to a further feature of the invention we provide a frame arrangement which includes a frame member, a panel movable relative to the frame member into a closed condition, and a keeper mounted to the frame member, characterised by a bolt unit as herein defined having the bolt unit mounted to the panel member, the bolt unit carrying a hollow receptor and a bolt having one end movable into the receptor, the keeper having an open-ended aperture to permit in said closed condition said one bolt end to pass into the keeper and then through the keeper and into the receptor.

Usefully the bolt can be key-locked in the second holding position.

The bolt when received in the receptor acts as the releasable arm of a padlock.

In a preferred (latching) arrangement the bolt is resiliently biassed towards an extended condition corresponding to the first holding position as above described; usefully the bolt (one) end is chamfered, and the roof of the keeper is angled to form a ramp directed towards the bolt housing whereby to provide a "slam shut" latching facility. Thus if the bolt is already partly extended from its housing, as the hinged (door) panel is swung towards the closed condition the bolt (one) end can abut the ramp whereby first to ride back against the spring and then to snap-fit (ride forward) into a first holding position within a fixed keeper. If the arrangement is used on a door, the bolt will snap-fit to a standard door holding position upon door closure.

With such slam-shut latching facility, the key or other bolt actuating means needs for example to be turned so as to retract the bolt one end from the keeper, against the spring force, in order that the door or other panel can be opened away from the frame.

Also in a preferred arrangement the bolt can be moved from inside the building to its second holding position by manually rotatable means, such as a thumb turn. Usefully however the manually rotatable means is a key whereby rotation of the key rotates a lock plug within a fixed lock barrel or body to cause an actuator carried by the plug to engage with the bolt; the bolt can only be released from its second holding position by use of the (correct) key or key part, the key also being used to withdraw the bolt from its first holding position to its door-opening retracted position.

The first and second holding positions are usefully determined by a control member pivotally or slidably mounted to the bolt housing, and resiliently biassed towards an operative or rest condition. When the abutment is rotated it can move the control member against a spring to permit a peg carried by, perhaps integral with, the bolt to traverse between spaced peg stops. The control member provides a dead-lock facility.

A cover is assembled over the bolt housing. When so fitted its projects beyond the edge of the panel, and preferably is shaped to soften any inadvertent user and visitor contact; specifically the cover prevents inadvertent contact with the bolt end, which in prior art arrangements for snap-shut latches is sharp-edged and exposed.

The cover can have an opening allowing access (when the panel is in an opened condition) to a screw whereby to permit fitting (and replacement) of the lock.

BRIEF DESCRIPTION OF THE DRAWINGS

The invention will be described by way of example with reference to the accompanying schematic drawings, not to scale, in which.

DESCRIPTION OF EXEMPLARY EMBODIMENTS

Figure 1:
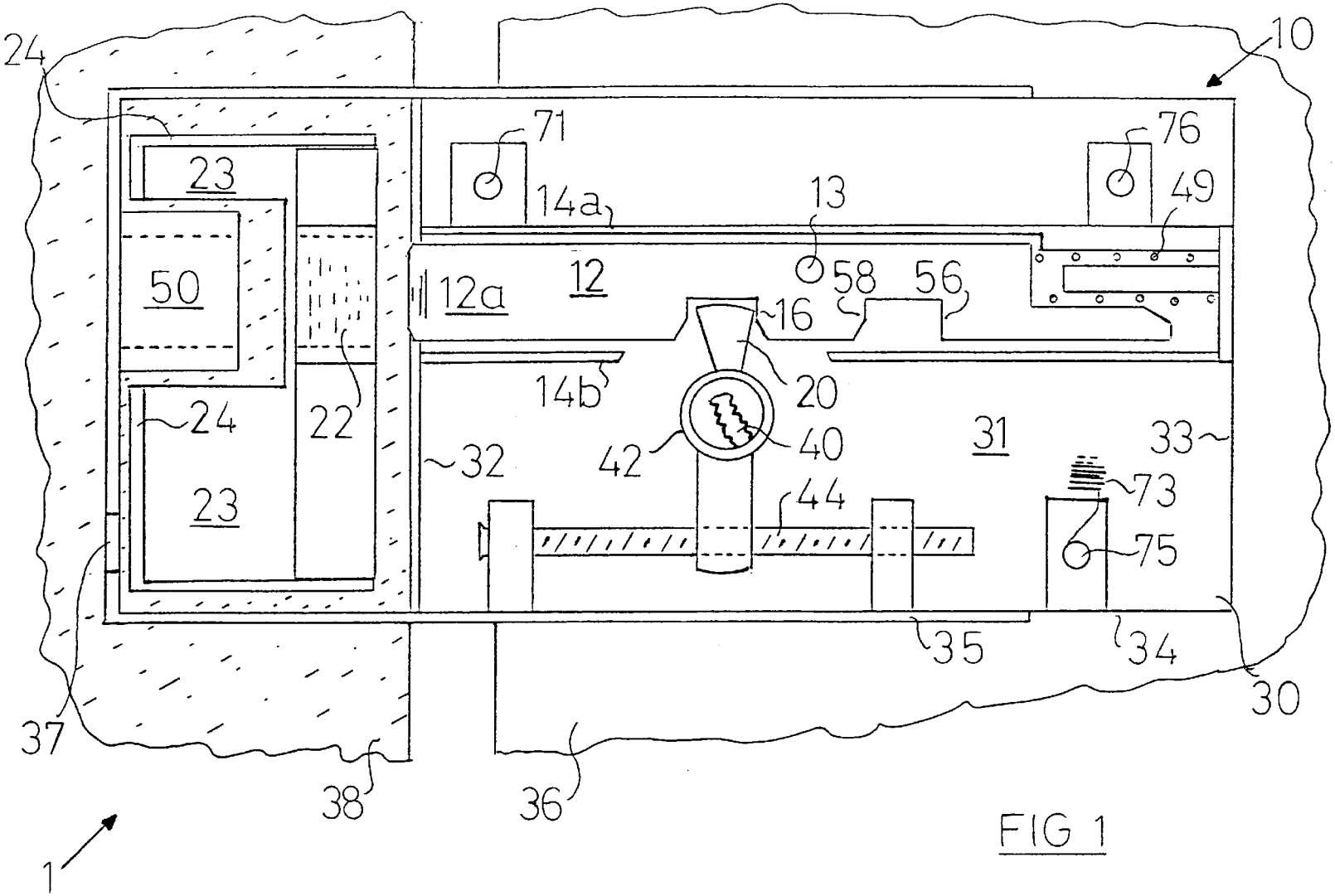
FIG. 1 is a side view of part of a frame arrangement with a bolt unit according to the invention, with the cover and other parts removed, and a cooperating keeper.

The frame arrangement 1 of FIG. 1 includes a bolt unit 10 having a slidable bolt 12 which is located between upper and lower guides 14*a*,14*b* in bolt housing 30. Bolt 12 is rectangular in cross section, and has its one end 12*a* chamfered.

Figure 4:
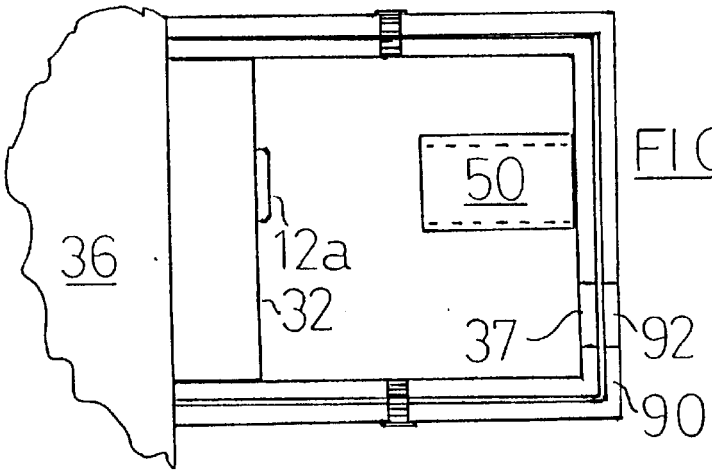
FIG. 4 is a reverse view of a bolt unit according to the invention fitted to a panel.

Bolt housing 30 comprises a flat base 31 having a left hand edge 32 and a right hand edge 33, joined by side edges 34. The guides 14*a*,14*b* upstand from base 31. As more fully described below, walls 35 upstand along part of the side edges 34 and provide a mounting for a cover 90 (FIG. 4). In an alternative embodiment walls 35 upstand completely around the base periphery.

The base 31 of bolt housing 30 in sue, and as shown in FIG. 1, is secured to a movable panel 36. The securement is usefully by nuts which cooperate with screws which project from a plate (not seen) so as to extend through movable panel 36 and through base plate 31. Movable panel 36 is hingedly mounted to an outer fixed frame, of which fixed upright 38 forms part, so as to swing from the closed position shown in FIG. 1, out of the paper towards a panel open position, for instance to the position of FIG. 4.

In this embodiment movable panel 36 is an external door of a building, and which therefore needs to be securable to prevent unauthorised access into the building, whilst fixed upright 38 is part of the door frame. Bolt unit 10 has a lockable bolt 12 as more fully described below, and is fitted as a lockable rim latch to the exposed inside surface of the door 36. A keeper 22 is mounted to fixed upright 38.

In a preferred embodiment edge 32 will overlie upright 38.

Part way along its length bolt 12 has an abutment surface 16. Guide 14*b* is cut away so that rotatable actuator 20 can engage this abutment surface.

The bolt unit has a retracted position, as shown in FIG. 1, with the actuator turned clockwise against bolt surface 16 to move the bolt against spring 49 out of the fixed keeper 22. In this position the bolt surface 16 abuts actuator 20 under the bias of spring 49. The door can now be opened, since the bolt end 12*a* is withdrawn from keeper 22.

With the door 36 closed against frame upright 38, and therefore with bolt 12 aligned with the aperture of keeper 22, the bolt unit has a first holding position wherein the bolt end 12*a* is receive din the keeper aperture, as commonly provided for in known rim latches. Thus initial anti-clockwise rotation of actuator 20 from its position of FIG. 1 allows spring 49 to move bolt end 12*a* into the keeper aperture. Subsequent clockwise movement causes actuator 20 to engage bolt surface 16 to effect bolt end 12*a* removal from the keeper aperture.

In an alternative embodiment, with door 36 in the closed condition and with an anti-clockwise rotation imparted to actuator 20, the actuator 20 itself moves the bolt so as to insert chamfered bolt end 12*a* into aperture provided by fixed keeper 22.

Actuator 20 can be rotated by a key inserted into the key slot 40 of the lock. The lock body 42 is held against rotation by screw 44 received in spaced threaded members secured to base 31, and in an alternative embodiment also to an extended sidewall 35. In further alternative embodiments actuator 20 can be turned by a thumb grip or a handle, or if the lock is double-ended by a key inserted from outside the door.

The bolt unit of FIG. 1 provides a latching or snap-shut closure action. Thus if the door is in an opened state with the bolt 12 in the first holding position, then if the door 36 is moved towards the closed state (into the paper) bolt end 12*a* will engage the shaped roof of keeper 22 with a ramp action such that bolt 12 can be pressed to the right against the force of spring 49, until bolt end 12*a* is aligned with the aperture in the keeper; when so aligned with the keeper aperture the bolt end 12*a* will be urged by spring 49 into the aperture (latching action). In this embodiment the keeper roof is angled towards the right whereby to provide a cam action with the chamfered bolt end 12*a* whereby to ease bolt movement rightwards.

It is a disadvantage of the known bolt unit and keeper arrangements having only the features such as those described above and which rely solely on this first holding position with the bolt one end 12*a* in keeper 22 that the bolt can be burst i.e. if a sufficiently strong (impact) force is applied to the door 36 in the opening direction (from behind the paper), then relative movement of the door and frame can allow bolt end 12*a* to detach from keeper 22 so that the door can unlawfully be opened even though bolt 12 is locked against rightwards movement relative to door 36.

It is a feature of the embodiment of FIG. 1 that housing 30 carries a receptor 50 which in the door closed condition will fit behind (to the left as viewed in FIG. 1) and aligned with the aperture of keeper 22. Thus in the door closed condition of FIG. 1 the keeper 22 is between the receptor 50 and the guides 14. Receptor 50 is secured to upstanding housing wall 35, which in this embodiment is of U-shape but in an alternative embodiment forms a closed upstanding loop, in both cases with only part of the wall 35 being connect to or integral with housing base plate 31 and in both cases with receptor 50 moving with bolt housing 30 upon hinging of door 36; in another embodiment receptor 50 is additionally or alternatively connected to spaced sections of the peripheral housing wall by upstanding struts or the like.

In use the housing 30 is shielded by a cover 90 (partly seen in FIG. 4) of inverted cup-shape and which fits around and is connected to the peripheral housing wall 35; the cover 90 is connected to wall 35 so as to provide extra strength and support to the upstanding peripheral wall.

Cover 90 in the position of use (FIG. 1) extends over and conceals keeper 22, and so prevents keeper 22 being disabled, as by being unlawfully cut or removed.

The cover 90 has an opening permitting key access to the actuator 20, in this embodiment by way of key slot 40 in a double-acting lock plug, the lock plug being turnable as above described in opposite angular directions within a lock barrel or body by the key.

It is a further feature of the embodiment of FIG. 1 that the cover is slotted or apertured at 92 and that wall 35 of housing 30 is slotted or apertured at 37, whereby to allow access to screw 44 which holds the lock barrel against movement, so that for instance an authorised locksmith can select and fit the lock after the housing components have been assembled. However keeper 22 is extended (downwardly in FIG. 1) at its full height so that access to screw 44 is denied when the door 36 is in the closed condition.

In this embodiment the keeper 22 is secured to the fixed upright 38 by screws in leftwardly extending flat, planar bosses 23; the bosses can have screw holes but preferably will have screw slots permitting the position of the keeper to be adjusted relative to housing 30 if door 36 sags relative to its frame i.e. relative to upright 38. The bosses 23 are vertically spaced by a sufficient distance to receive receptor 50 when door 36 is in the closed condition. The outer edges of the bosses 23 are strengthened by upstanding members 24, which in an alternative embodiment are so positioned and with their upper parts outwardly chamfered so as to act as a guide for the housing 30 as door 36 closes, ensuring that the keeper 22 and receptor 50 are aligned ready to receive bolt 12.

It is another feature of the embodiment of FIG. 1 that the bolt end 12*a* has two predetermined holding positions. The first holding position as described above is with the bolt end 12*a* within the keeper 22 whereby to permit a standard level of door retention as with the known rim latches. The second holding position is with the bolt end 12*a* at a greater extension from the guide 14 such that bolt end 12*a* is within receptor 50, whereby to permit an improved level of panel retention, both (a) because the shaft of bolt 12 is now within keeper 22 and held thereby, ad (b) because any attempt to force door 36 out of the paper causes the bolt end 12*a* to abut, or to abut more firmly, against receptor 50, with the bolt unit acting in padlock fashion.

Thus with the bolt unit in the second holding position, upon attempted forcible opening of door 36 the bolt end 12*a* does not burst from receptor 50, but instead bolt 12 and receptor 50 will move together since each is part of the bolt unit 10, with further movement of bolt 12 (if any) resisted by keeper 22.

The bolt has additional abutment surfaces 56, 58 which can be engaged by actuator 20 when the bolt end 12*a* has been moved into the keeper 22. The actuator 20 is capable of two complete revolutions, in opposite angular directions, and many key operated locks for instance have this facility; however, in the embodiment as described, the required movement is a part revolution (anti-clockwise from the FIG. 1 retracted position) of between 20 and 60 degrees, and then a single-throw further complete revolution to clear the surfaces 56,58. Further anti-clockwise rotation of actuator 20 is stopped upon engagement with the tail of bolt 12 (to the right as viewed in FIG. 1 of surface 56). The position of the abutment 58 is selected so that in the second holding position the bolt end 12*a* will fully enter receptor 50, which in this embodiment is backed by the upstanding housing wall, and so is single-ended.

In an alternative embodiment, abutment surfaces 56,58 are positioned to be engaged by a separate actuator, key-operated, preferably by a second key for even greater security. For multi-user facilities the second key can be held by security staff who lock the door(s) whilst copies of the first key can be issued to users who need to open the latched door (from the first holding position).

Figure 2:
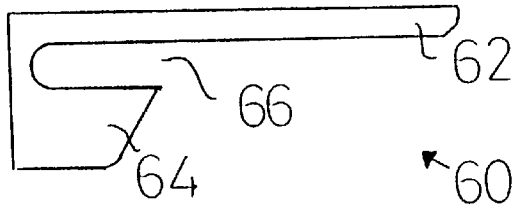
FIG. 2 is a side view of a bolt retainer for the unit of FIG. 1.

FIG. 2 is of a bolt retainer 60, of generally L-shape, with a function as described below. In the assembled unit plate arm 62 is secured to the guide 14*a* whilst plate body 64 is secured to guide 14*b*. Bolt retainer 60, housing base 31 and guides 14*a*,14*b* form an enclosed channel within which a part of bolt 12 can slide and which can help retain bolt 12 in the housing, specifically between guides 14*a,b* without interfering with the operation of actuator 20.

Between plate arm 62 and plate body 64 is a recess 66 of a size to receive upstanding bolt peg 13 when the bolt end 12*a* is within the receptor 50, to locate peg 13 and to inhibit lateral banding of bolt 12 during any unauthorised attempt to disable the latch, as by attempted lifting of the door 36 relative to the upright 38.

Figure 3:
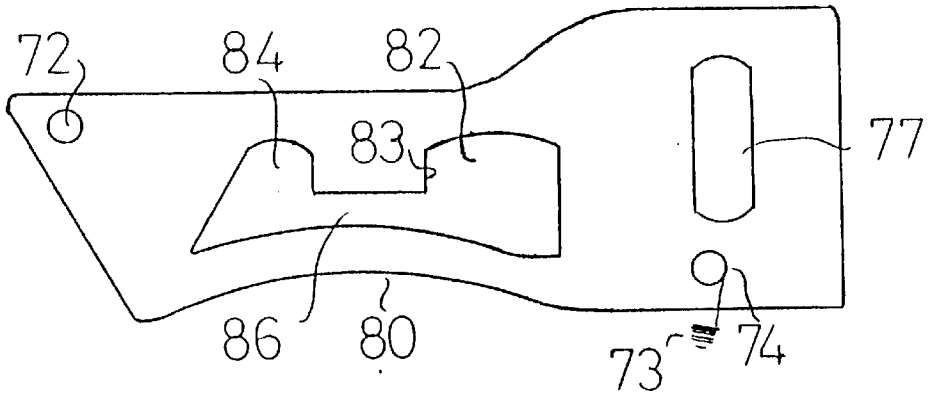
FIG. 3 is a side view of the control member for the unit of FIG. 1.

FIG. 3 is of a control member 70 providing a bolt traverse limiting means. Control member 70 has a through-opening 72 of a size to fit upon the upstanding post 71 of the bolt housing 30; opening 72 is circular, as is the post 71 in cross section, so that the control member 70 can be pivoted about post 71.

Control member 70 is urged clockwise about the post 71 by spring 73 extending between control member post 74 and housing post 75. Pivoting movement of member 70 is restrained by upstanding housing post 76 which is received in a slot 77 of the control member, and in the clockwise direction by a depending plate (not shown) which normally is in contact with the guide 14*a*.

Control member 70 has openings 82 and 84, joined by a passageway 86 of a size to permit bolt peg 13 to pass from opening 82 to opening 84 whereby to allow bolt end 12*a* to enter the receptor 50.

Control member 70 has a cam surface 80, adapted with the actuator 20 in the position shown in FIG. 1 to be engaged by the actuator 20 and thus to be lifted against the action of spring 73. Thus in the actuator 20 position of FIG. 1, the control member has been lifted, and bolt peg 13 is against (in an alternative embodiment adjacent) surface 82.

Anti-clockwise rotation of the lock plug will now move actuator 20 out of engagement with cam surface 80 to allow spring 73 to return the control member clockwise to its rest position; bolt 12 is also moved (in this embodiment by spring 49 as above described) until peg 13 abuts surface 83.

Further anti-clockwise rotation of the lock plug during the single throw will cause actuator 20 first to lift surface 80, and then to engage bolt surface 58, whereby the peg 13 can travel along passageway 86 into opening 84 before further rotation of actuator 20 allows spring 73 to cause the control member to return towards its rest position whereby to trap peg 13 in opening 84. Thus control member 70 provides an additional degree of dead-lock security, preventing the bolt retracting from the receptor if for instance the spring 49 is damaged or removed.

Whilst in opening 84 the bolt peg 13 is also in slot 66 of bolt retainer 60, and so cannot inadvertently enter passageway 86.

When the bolt 12 is to be retracted, clockwise movement of actuator 20 lifts control member 70 to an inoperative position before bolt surface 56 (and subsequently on the second actuator rotation bolt surface 16) is contacted.

It is a further feature of the invention that in the door open condition the receptor 50 is spaced inwardly (to the left as viewed in FIG. 1) from the door edge. The receptor in the fully assembled unit is however within the cover 90. The exposed edges of the cover and of the housing upstanding wall, as seen in FIG. 4, will usefully be shaped for increased personal safety; specifically if the bolt is in its first holding position with the door open, the edges of bolt end 12*a* are also within the cover and not exposed.

Figure 5:
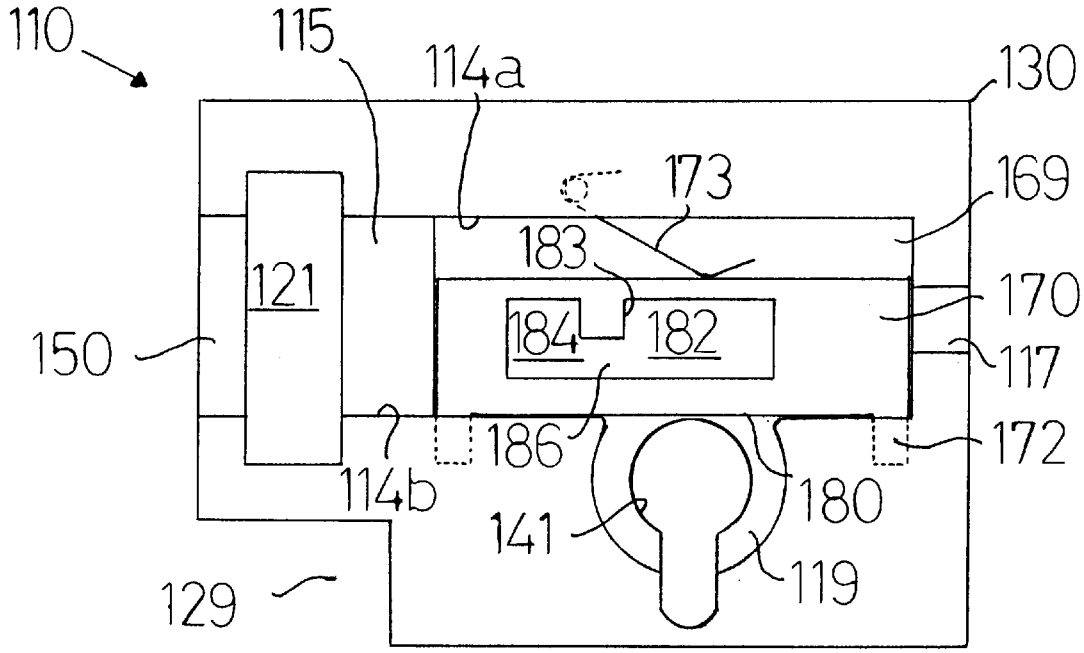
FIG. 5 is a side view of part of another embodiment of bolt unit, with the cover and bolt removed.

FIG. 5 shows an alternative embodiment of bolt unit 110. The bolt unit is mounted in a housing 130, which housing has a through opening 121 into which the keeper (not shown in FIG. 5, but see the keeper of FIG. 8 or 11, for example) can enter.

In an alternative embodiment, the opening is closed to one side, as by the cover of the housing.

Figure 6:
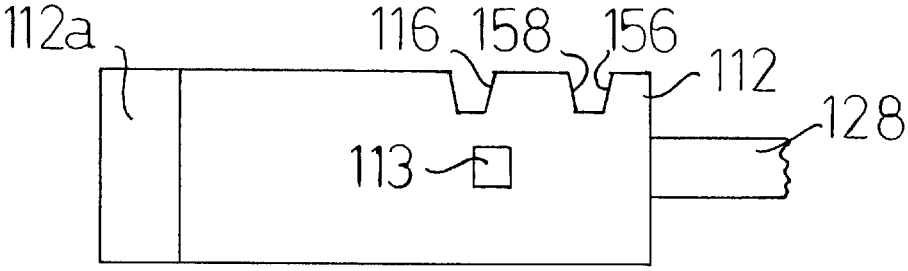
FIG. 6 is a view of the rear face of the bolt for the unit of FIG. 5 and showing an axially movable manual retraction rod for the bolt.
Figure 7:
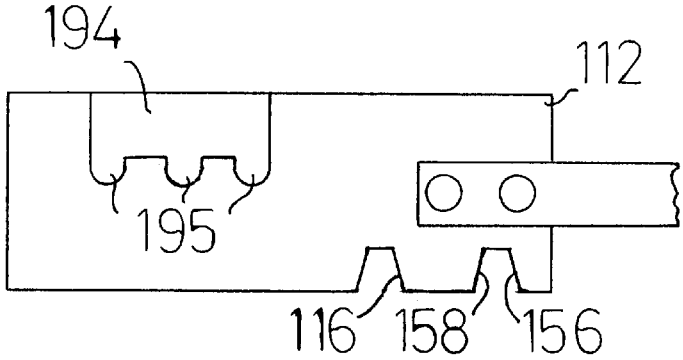
FIG. 7 is a view of the front face of the bolt for the unit of FIG. 5.

The housing 130 has guides 114*a*,114*b* to locate and guide bolt 112 (FIGS. 6,7). Integral with the housing 130 is the receptor 150, into which the bolt can project when in its second holding position.

In a recess 169 in the housing 130 is located a plate-like control member 170. The control member 170 has a pair of openings 182,184, joined by a passageway 186, the openings and passageway being adapted to accommodate a peg 113 on the bolt 112 (FIG. 6). The control member is slidable in the recess 169 in a direction transverse to the direction of movement of the bolt 112. The control member can move between a rest or operative position (as shown) in which the peg 113 will be retained in one or other of the openings 182,184, and an inoperative position in which the peg 113 will be able to be moved along the passageway 186 between the openings. Sliding movement of the control member is guided by lugs 172 which fit into suitably-shaped recesses in the housing, and the control member is biassed towards its rest position by spring 173.

The control member 170 has an edge 180 which lies adjacent the barrel of a lock (not shown) which can be fitted into standard opening 141. The lock barrel will carry an actuator (also not shown) which can be rotated in recess 119. The edge 180 is engageable by the actuator, so that the control member can be moved by the actuator to its inoperative position. Depending upon the position of the bolt 112 and the direction of rotation of the lock, the actuator can also engage one or other of surfaces 156 and 158 in the bolt 112 (FIGS. 6,7), so that following movement of the control member to its inoperative position rotation of the lock can cause the actuator to drive the bolt between its first holding position and its second holding position, and vice versa.

It will be understood that in the embodiments of FIGS. 3 and 5 that the respective opening 82,182 in the control member permits movement of the bolt between its first holding position and its non-holding position (and vice versa) without requiring the control member to be pivoted or moved to its inoperative position, i.e. the opening 82,182 is large enough to permit the necessary movement of the respective peg 13,113. Thus, the bolt can be moved from its first holding position to its non-holding position by means other than the lock actuator 20, e.g. by its chamfered end 112*a* engaging the keeper. However, in order to move the bolt between its first and second holding positions it is necessary for the actuator to move the control member so that the peg can pass along the respective slot 86,186. The control member 70,170 can thus provide additional security to the bolt in its second holding position. It will be understood, however, that the control member could have an additional opening connected to opening 82,182 by a passageway similar to passageway 86,186, so that movement of the bolt between its non-holding and first holding positions also requires prior movement of the control member by the actuator; such a bolt would not have a latching action.

The thickness of the control member 170 is substantially the same as the depth of the recess 169, so that in the assembled condition of the bolt unit the bolt 112 engages the control member 170 as well as housing surface 115 and guides 114*a*,114*b*.

The bolt 112 is urged towards its first holding position by a spring (not shown); in this position the peg 113 engages surface 183 of opening 182. However, the bolt 112 has a chamfered end 112*a*, so that if the bolt unit is closed upon a keeper, the bolt 112 may be forced back against the spring, until the bolt end 112*a* is able to enter the keeper aperture (during this movement, the peg 113 moves within openings 182, away from surface 183).

Thus, in this embodiment, the bolt unit is spring biassed into its first holding position (to act as a latch), and may be moved to its second holding position only upon rotation of the actuator under the control of the lock. In an alternative embodiment, the bolt is not spring biassed, and movement of the bolt between any of its respective positions can only be effected by rotation of the actuator; in such an embodiment, it will be understood that the bolt unit acts as a "double dead lock", so that the bolt will not be chamfered.

Part of the bolt housing 130 is removed at 129, to save weight and also to permit easier access to the screw which will be required to fix the lock barrel in place. The housing also has a slot 117, to accommodate rod 128 which can be connected to a manually grippable handle or the like, so that the bolt may be moved between its first holding position and its non-holding position by way of the handle as well as (or in some embodiments instead of) the key-operated lock.

As shown in FIG. 7, the bolt 112 also has a detent means 194, which comprises a recess cut into the bolt and which has three wells 195 which can receive a detent lug (not shown) carried by the cover of the housing. The detent lug is manually movable into and out of a respective well, and when fitted into one of the wells 195 can secure the bolt 112 in one of its non-holding, first holding and second holding positions respectively.

Figure 8:
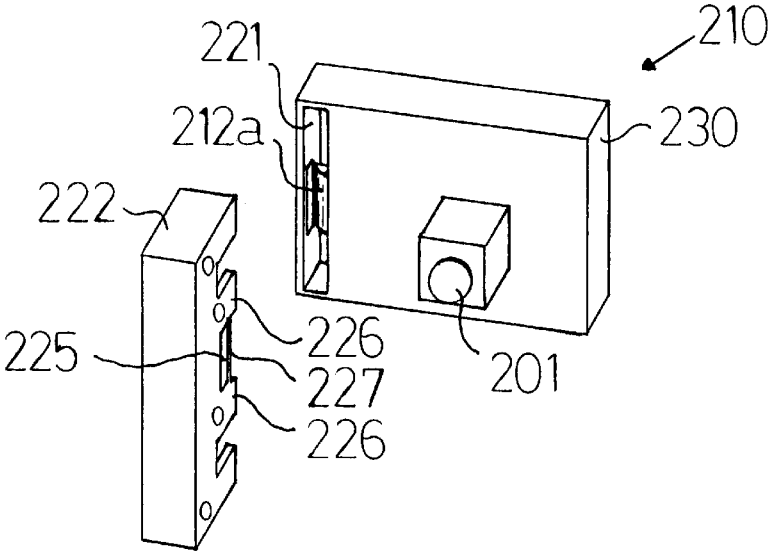
FIG. 8 is a perspective view of yet another embodiment of bolt unit and keeper arrangement.
Figure 9:
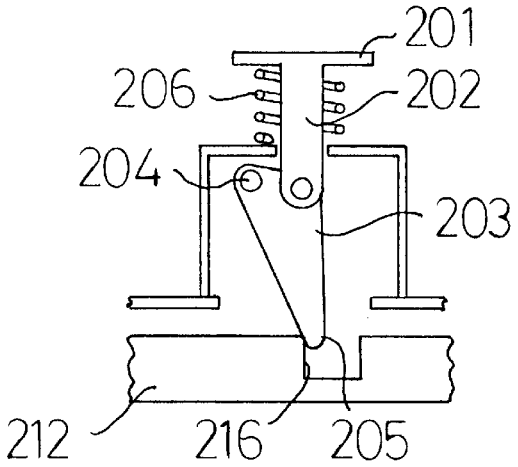
FIG. 9 is a sectional view of part of the bolt unit of FIG. 8.

The embodiment of FIGS. 8 and 9 shows a bolt unit and keeper for use as a "panic" bolt, in which a button 201 can be pressed to move the bolt 212 between its first holding position (as shown in FIG. 8) and its non-holding position. The button 201 is mounted on a rod 202 which is pivotably attached to a pivot plate 203. Pivot plate 203 is mounted upon fixed pivot 204, and has an end 205 which engages abutment surface 216 of the bolt 212.

The housing 230 includes an opening 221 to receive part of the keeper 222. The keeper includes a keeper aperture 225 which has a projection 226 to either side. When the bolt unit and keeper are brought together, the keeper aperture 225 and the projections 226 enter the opening 221 in the housing 230, with the bolt end 212*a* entering the keeper aperture 225.

Figure 10:
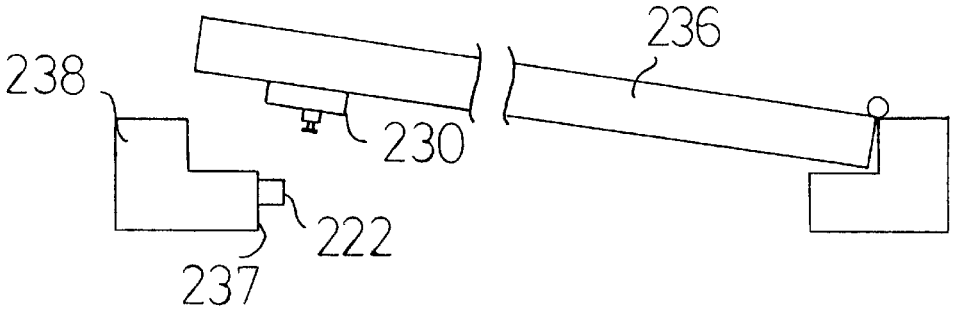
FIG. 10 is a schematic view of the bolt unit and keeper of FIGS. 8 and 9 in use (frame and panel not shown)

The enlarged form of keeper 222 is used in this embodiment so that it can cooperate with the housing 230 fitted to the inside surface of an outwardly opening door 236, as shown schematically in FIG. 10. Thus, it is necessary for the keeper aperture to be mounted spaced away from the edge 237 of the fixed frame member 238 to which the keeper is secured.

In this embodiment, both of the bolt tip 212*a* and the keeper 222 are chamfered, the bolt tip 212*a* being able to ride up the keeper chamfer 227 when the bolt unit and keeper are brought together, to provide a "slam shut" latching facility. Though not shown in the figures, the bolt unit can include a key operated facility, by which it may be moved to its second holding position when required, in which position the button 201 becomes inoperative.

It will be understood that the button 201 can be replaced by a pivoting plate, sometimes referred to as a "paddle".

In FIG. 9, the button 201 is shown to be biassed by a spring 206, though the spring (not shown) which urges the bolt (rightwards in this figure) into its first holding position could alternatively be used to bias the button by way of the plate 203.

Figure 11:
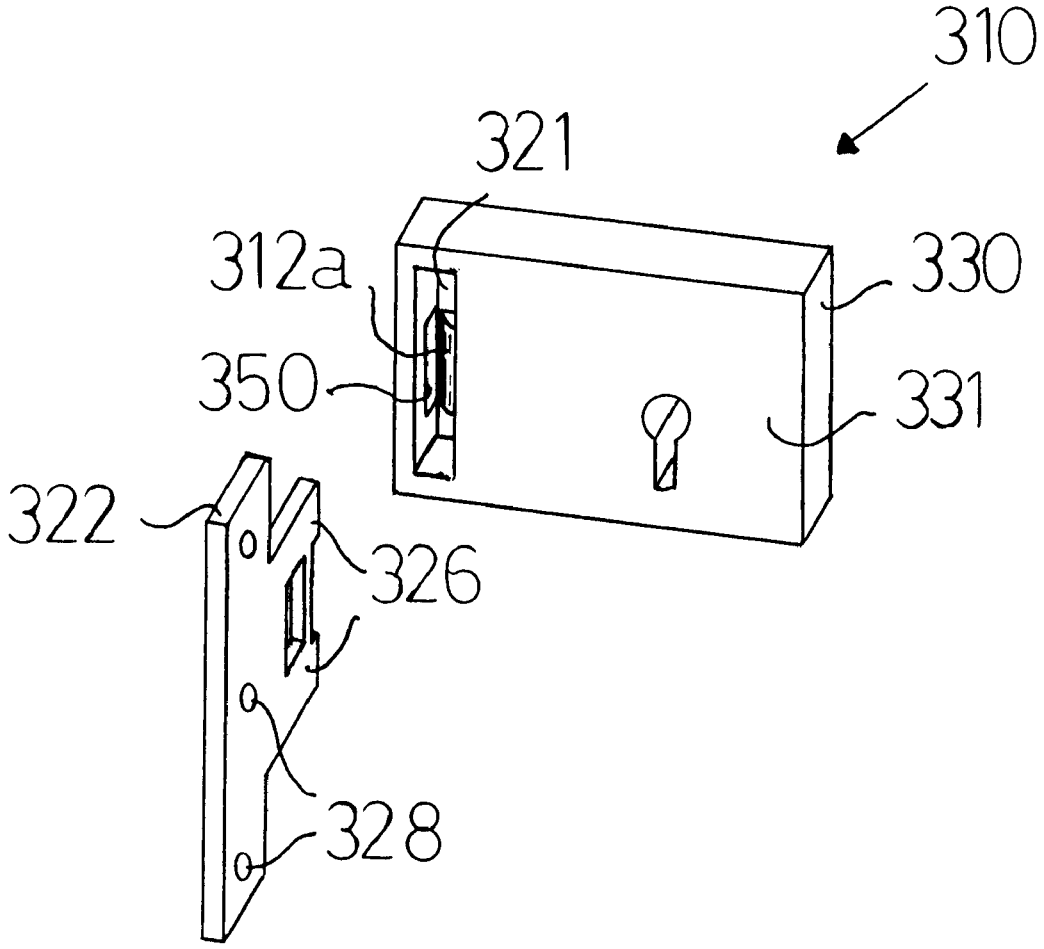
FIG. 11 is a perspective view of a bolt unit and keeper arrangement ready for use, the bolt unit being similar to that of FIG. 5, but of opposite hand.

In the embodiment of FIG. 11, a bolt unit and keeper arrangement is shown which is suitable for an inwardly opening panel in which the bolt unit is secured to the inside surface of the panel. Such an embodiment is commonplace for the doors of domestic dwellings, for example. In the fitted condition, the housing 330 can have its face 331 secured to the panel by known means, and the keeper 322 can be secured to the edge of a frame member by way of screws or the like passing through holes 328; alternatively, the housing 330 can be morticed into the panel, with the frame being suitable rebated (around the keeper) to receive the receptor 350 and its associated carrying parts.

The housing 330 has an opening to receive a known lock barrel which is double-ended, in that it may be operated by the insertion of a key from both inside and outside of the panel. In addition, the housing 330 has a through opening 321, so that the ends of the keeper projections 326 can pass though the housing. However, in other embodiments the opening is closed at its side opposed to the keeper insertion side, as by the cover for the housing.

It is an advantage of our embodiments that when in the second holding position the bolt unit and keeper has the characteristics of a padlock, with the fixed keeper acting as a sample through which the bolt passes to connect the two sides of the housing 30,130,230,330 e.g. the base 31 and the receptor 50. In certain embodiments therefore, the bolt unit can be used "loose" i.e. not fitted to a panel, the bolt being adapted to secure a hasp to a staple for example. There is the further advantage with our preferred embodiments that the fixed keeper (or hasp) is substantially or fully concealed by the fitted cover when the panel is in its closed position, and so cannot be tampered with when the bolt unit is in the first or second holding position. Thus the provision of the receptor carried by the bolt housing, with the housing able to embrace and surround the fixed keeper for example allows the standard type door lock with a cantilevered bolt end to become equivalent to a concealed padlock with supported ends.

Whilst in this description reference has primarily been made to a hinged door panel, it will be understood that the bolt could be used for sliding panels if the housing is hingedly mounted e.g. to the door panel. The housing would be hinged out of the paper until the panel is closed, and then would be swung to the position of FIG. 1 with the receptor aligned with the keeper.

The bolt unit can be used for other applications, such as a closure for a container panel, and may be lockable from one side only for thick factory doors which might otherwise require a deep lock and a correspondingly large aperture in the door. Also for convenience the panel has been described as securable (against hinged or sliding movement) to a fixed upright, though it could be secured to a horizontal fixed member or to an angled part of an outer fixed frame.

It will be understood that the cooperating parts of the control member 70,170 and its respective bolt 12, 112 could be reversed, with the control member carrying the peg and the openings and passageway(s) being formed in (perhaps recessed into) the bolt.

Thus we provide an advantageous new dead-locked safety lock with the beat features of a rim lock and a padlock, with concealed parts in use. We also provide a bolt unit in which a single bolt member can act as a latch (in its first holding position) and as a dead bolt (in its second holding position), and in which a single actuator can control both of these functions, in place of the separate (and separately actuated) latch member and bolt member which are currently available.

What is claimed is:

1. A bolt unit which includes a bolt housing, bolt guides in the housing and a bolt, wherein the bolt has a maximum thickness and a thickness substantially equal to the maximum thickness for most of its length, and further wherein the bolt has a longitudinal axis and is slidable along the longitudinal axis between said guides so that one end of the bolt can be outside the housing;

actuating means for the bolt in the housing;

a hollow receptor for said one end of the bolt outside of the housing, said receptor being carried by the housing and movable therewith;

the actuating means comprising a two-stage bolt movement means including a first stage bolt movement means acting to cause said one end of the bolt to move to a first position adjacent the receptor and a second stage bolt movement means acting to cause said one end of the bolt to move from said first position to a second position within the receptor;

a control member alongside a part of the bolt, the control member being movable by the actuating means in a direction transverse to the longitudinal axis of the bolt, the control member having an operative position in which it can limit sliding movement of the bolt, the bolt unit being adapted to receive a part of a keeper between the bolt guides and the receptor, the bolt unit having a cover enclosing at least a part of the housing and the receptor whereby when the part of the keeper is received between the housing and the guides it is concealed by the cover.

2. A bolt unit according to claim 1 wherein there is a resilient bias means in the housing, said resilient bias means acting to urge the said one end of the bolt in a direction away from a non-holding position and towards said first position, and said one end of the bolt has a chamfer, with a chamfer angle relative to said direction such that a force against said chamfer and substantially perpendicular to said direction can cause said one end to move away from said first position and towards said non-holding position.

3. A bolt unit according to claim 2 wherein the first and second stage bolt movement means comprise a rotatable actuator, rotatable by a key inserted into an associated lock.

4. A bolt unit according to claim 1 wherein the control member is slidably mounted in the housing, and in that biasing means urges the control member towards its operative position.

5. A bolt unit according to claim 4 wherein the control member has openings, the bolt has an upstanding peg which can engage in each opening to determine the first and second positions of the bolt, the openings are connected by a passageway for the upstanding peg, and an actuator can move the control member against said biasing means to disengage the peg from the respective opening whereby to allow the peg to traverse along the passageway and into engagement with the other of said openings.

6. A method of securing a structural assembly including a bolt unit and frame arrangement, comprising:

providing the bolt unit which includes a bolt housing, bolt guides in the housing and a bolt, wherein the bolt has a maximum thickness and a thickness substantially equal to the maximum thickness for most of its length, and further wherein the bolt has a longitudinal axis and is slidable along the longitudinal axis between said guides so that one end of the bolt can be outside the housing;

actuating means for the bolt in the housing;

a hollow receptor for said one end of the bolt outside of the housing, said receptor being carried by the housing and movable therewith;

the actuating means comprising a two-stage bolt movement means, including a first stage bolt movement means acting to cause said one end of the bolt to move to a first position adjacent the receptor, and a second stage bolt movement means acting to cause said one end of the bolt to move from said first position to a second position within the receptor;

a control member alongside a part of the bolt, the control member being movable by the actuating means in a direction transverse to the longitudinal axis of the bolt, the control member having an operative position in which it can limit sliding movement of the bolt;

the bolt unit being adapted to receive a part of a keeper between the bolt guides and the receptor, the bolt unit having a cover enclosing at least a part of the housing and the receptor whereby when the part of the keeper is received between the housing and the guides it is concealed by the cover;

securing the bolt unit to a movable panel; and securing the keeper to a fixed frame for the panel;

wherein the keeper has an open-ended aperture, the panel is movable to align the keeper aperture with and between the guides and the receptor, and the cover for the bolt unit covers the receptor and in the position of use also covers the keeper.

7. A frame arrangement which includes a frame member, a panel movable relative to the frame member into a closed condition, and a keeper mounted to the frame member, with a bolt unit mounted to the panel member, the keeper having an open-ended aperture to permit in said closed condition one bolt end to pass into the keeper and then through the keeper and into a hollow receptor, said bolt unit including a bolt housing;

bolt guides in the housing; and a bolt, wherein the bolt has a maximum thickness and has a thickness substantially equal to the maximum thickness for most of its length, and further wherein the bolt has a longitudinal axis and is slidable along the longitudinal axis between said guides so that one end of the bolt can be outside the housing;

actuating means for the bolt in the housing;

the hollow receptor for said one end of the bolt outside of the housing, said receptor being carried by the housing and movable therewith;

the actuating means comprising a two-stage bolt movement means including a first stage bolt movement means acting to cause said one end of the bolt to move to a first position adjacent the receptor and a second stage bolt movement means acting to cause said one end of the bolt to move from said first position to a second position within the receptor;

a control member alongside a part of the bolt, the control member being movable in a direction transverse to the longitudinal axis of the bolt, the control member having an operative position in which it can limit sliding movement of the bolt;

the bolt unit being adapted to receive a part of the keeper between the bolt guides and the receptor, the bolt unit having a cover enclosing at least a part of the housing and the receptor whereby when the part of the keeper is received between the housing and the guides it is concealed by the cover.

8. A frame arrangement according to claim 7 wherein the bolt includes detent means with axially spaced wells adapted alternately to receive a detent lug, and the housing mounts manual bolt retraction means, said retraction means allowing manual withdrawal of the bolt from the keeper when said detent lug has been removed from the detent means.

9. A bolt unit according to claim 1 wherein the control member is pivotally mounted in the housing, and biasing means urges the control member towards its operative position.

10. A bolt unit comprising:

a bolt housing;

bolt guides in the housing; and a bolt having a maximum thickness and having a thickness substantially equal to the maximum thickness for most of its length, and further wherein the bolt has a longitudinal axis and is slidable along the longitudinal axis between said guides so that one end of the bolt can be outside the housing, actuating means for the bolt in the housing;

a hollow receptor for said one end of the bolt outside of the housing, said receptor being carried by the housing and movable therewith;

actuating means comprising a two-stage bolt movement means comprising (1) a first stage bolt movement means acting to cause said one end of the bolt to move to a first position adjacent the recepot; and (2) a second stage bolt movement means acting to cause said one end of the bolt to move from said first position to a second position within the receptor, and wherein the first stage bolt movement means and the second stage bolt movement means comprise the same actuator part a control member alongside a part of the bolt, the control member being movable in a direction transverse to the longitudinal axis of the bolt, the control member having an operation position in which it can limit sliding movement of the bolt;

the bolt unit being adapted to receive a part of a keeper between the bolt guides and the receptor, the bolt unit having a cover enclosing at least a part of the housing and the receptor whereby when the part of the keeper is received between the housing and the guides it is concealed by the cover.

11. A bolt unit comprising:

a bolt housing;

bolt guides in the housing;

a bolt slidable between said guides so that one end of the bolt can be outside the housing;

actuating means for the bolt in the housing;

a hollow receptor for said one end of the bolt outside of the housing, said receptor being carried by the housing and movable therewith;

the actuating means comprising a two-stage bolt movement means including:

(1) a first stage bolt movement means acting to cause said one end of the bolt to move to a first position adjacent the receptor; and (2) a second stage bolt movement means acting to cause said one end of the bolt to move from said first position to a second position within the receptor;

the bolt unit being adapted to receive a part of a keeper between the bolt guides and the receptor;

resilient bias means in the housing acting to urge the said one end of the bolt in a direction away from a non-holding position and into said first position;

said one end of the bolt having a chamfer which in use is engageable by the keeper when the bolt is in its first position, with a chamfer angle relative to said direction such that a force against said chamfer and substantially perpendicular to said direction can cause said one end to move away from said first position and towards said non-holding position whereby a part of the keeper can pass said one end of the bolt, whereby the first position is a bolt latching position and the second position is a bolt locking position.

* * * * *

UNITED STATES PATENT AND TRADEMARK OFFICE

CERTIFICATE OF CORRECTION

PATENT NO. : 6,148,650
DATED : November 21, 2000
INVENTOR(S) : Anthony Wilfred Kibble It is certified that error appears in the above-identified patent and that said Letters Patent is hereby corrected as shown below:

Column 1,
Line 39, change “and” to -- end --.
Line 58, change “peprhaps” to -- perhaps --.

Column 4,
Line 15, change “its” to -- it --.

Column 5,
Line 4, change “sue” to -- use --.
Line 34, change “receive din” to -- received in --.

Column 6,
Line 20, change “connect” to -- connected --.

Column 10,
Line 53, change “suitable” to -- suitably --.
Line 64, change “has” to -- have --.

Column 14,
Line 7, change “recepot” to -- receptor --
Line 16, change “operation” to -- operative --.

Signed and Sealed this

Twenty-fourth Day of August, 2004

JON W. DUDAS
*Director of the United States Patent and Trademark Office*